US010941571B2

(12) United States Patent
Wasniewski

(10) Patent No.: US 10,941,571 B2
(45) Date of Patent: Mar. 9, 2021

(54) SET OF MODULAR TIMBER HOLLOW BRICKS WITH THERMAL INSULATION PROPERTIES

(71) Applicant: CONSTRACT ECO DOMY sp. Z o.o., Rozental (PL)

(72) Inventor: Kacper Wasniewski, Ostrada (PL)

(73) Assignee: CONSTRACT ECO DOMY sp. Z o.o., Rozental (PL)

( * ) Notice: Subject to any disclaimer, the term of this patent is extended or adjusted under 35 U.S.C. 154(b) by 0 days.

(21) Appl. No.: 16/532,908

(22) Filed: Aug. 6, 2019

(65) Prior Publication Data

US 2020/0048903 A1 Feb. 13, 2020

(30) Foreign Application Priority Data

Aug. 9, 2018 (PL) ..... 426221

(51) Int. Cl.

| | |
|---|---|
| ***E04C 1/41*** | (2006.01) |
| ***E04B 2/46*** | (2006.01) |
| ***E04B 2/42*** | (2006.01) |
| ***E04B 1/66*** | (2006.01) |
| ***E04B 1/88*** | (2006.01) |
| ***E04C 2/10*** | (2006.01) |
| ***E04C 1/40*** | (2006.01) |

(52) U.S. Cl.

CPC ..... *E04C 1/41* (2013.01); *E04B 1/66* (2013.01); *E04B 1/88* (2013.01); *E04B 2/42* (2013.01); *E04B 2/46* (2013.01); *E04C 1/40* (2013.01); *E04C 2/10* (2013.01)

(58) Field of Classification Search

CPC ..... E04C 1/41; E04C 2/10; E04C 1/40; E04B 1/88; E04B 1/66; E04B 2/42; E04B 2/46

USPC ..... 52/272, 275, 284, 285.1, 286, 255, 444, 52/503, 504, 596, 600, 60, 4

See application file for complete search history.

(56) References Cited

U.S. PATENT DOCUMENTS

| | | | | | |
|---|---|---|---|---|---|
| 2,294,776 | A * | 9/1942 | Freeman | E04B 2/18 | 52/591.1 |
| 2,311,628 | A * | 2/1943 | Andrews | E04B 2/42 | 52/438 |
| 2,352,338 | A * | 6/1944 | Muirhead | E04B 1/72 | 52/439 |
| 2,611,261 | A * | 9/1952 | Preston | E04B 2/42 | 52/347 |
| 3,936,987 | A * | 2/1976 | Calvin | E04B 2/08 | 52/309.1 |

(Continued)

*Primary Examiner* — Brent W Herring
(74) *Attorney, Agent, or Firm* — Craft Chu PLLC; Andrew W. Chu

(57) ABSTRACT

The set of modular timber hollow bricks with thermal insulation properties includes wooden hollow bricks, marked as A and B which have a box structure. Hollow brick A and corner hollow brick B include two boards connected by crossbars in such a way, that they form a peripheral socket on the inside for a connection with the connector. The corner hollow brick B also has a connector on the side surface of the board. Each hollow brick has a circumferential socket, the size of which corresponds to half the thickness of the connector. The corner hollow brick B has a notch on the lateral surface. The hollow brick A and corner hollow brick B have each an additional reinforcing bar inside. The socket is filled with sealing foam before assembly.

3 Claims, 1 Drawing Sheet

(56) References Cited

U.S. PATENT DOCUMENTS 4,004,385 A * 1/1977 Kosuge ..... E04B 2/54 52/259
4,148,166 A * 4/1979 Toone ..... E04B 2/44 52/270
D266,363 S * 9/1982 Coelho dos Santos ..... D25/114
4,989,386 A * 2/1991 Collis ..... E04B 1/10 52/584.1
6,256,960 B1 * 7/2001 Babcock ..... E04B 1/14 52/281
6,698,157 B1 * 3/2004 Porter ..... E04C 2/22 52/309.2
6,799,405 B2 * 10/2004 Gilbert ..... E04B 2/46 52/592.6
7,549,263 B1 * 6/2009 Porter ..... E04B 1/14 52/127.7
8,065,846 B2 * 11/2011 McDonald ..... E04C 2/384 52/262
8,074,419 B1 * 12/2011 Humphress ..... E04B 2/46 446/120
8,151,539 B2 * 4/2012 Grinsted ..... E04C 2/205 52/220.2
8,549,811 B2 * 10/2013 Dyson ..... E04B 2/46 52/604
9,828,766 B2 * 11/2017 Mori ..... E04C 1/39
2004/0128936 A1 * 7/2004 Gilbert ..... E04B 2/46 52/604
2007/0094963 A1 * 5/2007 McDonald ..... E04B 5/14 52/270
2009/0205277 A1 * 8/2009 Gibson ..... E04B 7/22 52/309.9
2010/0223876 A1 * 9/2010 Jones ..... E04B 2/08 52/588.1
2011/0067331 A1 * 3/2011 Grinsted ..... E04B 1/14 52/309.4
2012/0247043 A1 * 10/2012 McDonald ..... E04C 2/384 52/309.7
2019/0383004 A1 * 12/2019 Waters ..... E04C 1/41

* cited by examiner

SET OF MODULAR TIMBER HOLLOW BRICKS WITH THERMAL INSULATION PROPERTIES

CROSS-REFERENCE TO RELATED APPLICATIONS

See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The subject of the invention is a set of modular timber hollow bricks with thermal insulation properties. A set of modular hollow bricks can be used to build light structures, such as summer houses, gazebos, garages, partitions walls, floors, ceilings, etc.

2. Description of Related Art Including Information Disclosed Under 37 CFR 1.97 and 37 CFR 1.98

A multi-layer construction element with an insert, where the edges of the outer layers of the element protrude from all four sides beyond the periphery of the insulating core, forming a seat for the insert made in the form of a cuboid is known from the patent application P.322012 as a multi-layer element consisting of claddings forming outer layers connected by an insulating core transforming indirectly into the insulation core of the element by joining together the side plane of the element core and the side plane of the insert. The joined side planes of the element cores and the inserts have grooves, preferably semi-circular, forming channels along their whole length.

Another construction module is also known, according to Polish patent application No. P. 336 370, intended for skeleton wall construction, which has equally spaced load-bearing posts, joined into a rigid connection by spacer boards. In this solution, vertical forces of the created structure are transmitted by posts joined using tenon connections into rows of timber hollow bricks with boreholes.

From utility model No. 67743, a set of modular soundproofing hollow bricks consisting of two elements marked as A and B is also known, hollow bricks which are cuboidal solids, and on two opposite, smaller surfaces have protrusions and notches forming tongue-groove system, each the protrusion and the notch have the outline similar in shape to the trapezium. The first modular soundproofing hollow brick A of the set has the form of a full rectangular solid with pairs of protrusions and notches, forming a tongue-and-groove system, placed on two opposite, smaller surfaces. Each protrusion and notch have a shape similar to that of a trapezoid, wherein two longitudinal grooves for the reinforcing bars located in the upper surface of the hollow brick. The grooves run parallel to each other and parallel to the longer sides of the hollow brick, from the area where the protrusion-notch, to the area of the notch-groove.

The second modular soundproofing hollow brick B of the set has the form of a rectangular solid, on the top and bottom surface of which there are boreholes in three parallel rows, arranged vertically, with an outline similar to rectangles with rounded corners. Their longer sides are parallel to the long sides of the hollow brick B, In the middle part of hollow brick B there are two identical boreholes, and on both sides of these boreholes, at the longer side walls of hollow brick B, there are three boreholes of the same size. The side segments are their own reflections. The boreholes in the middle part of the hollow brick are 1.5 times longer than the boreholes on its sides. On the two opposite, smaller surfaces of hollow brick B there are pairs of protrusions and notches forming a tongue-and-groove system, and each protrusions and notches in four different rows has a cross-sectional outline similar to that of a trapezium.

BRIEF SUMMARY OF THE INVENTION

The objective of the solution, according to the invention, is to arrive at light building elements of various sizes which, in their sets. will form modules for construction of walls, floors, and ceilings of a structure, with thermo-insulation properties.

The essence of a set of modular timber hollow bricks with thermal insulation properties, according to the invention, is that it consists of wooden hollow bricks, marked as A and B which have a box structure. Hollow brick A and corner hollow brick B of the set consists of two boards connected by crossbars in such a way, that they form a peripheral socket on the inside for a connection with the connector, and the corner hollow brick B also has a connector on the side surface of the board. Preferably, the hollow brick A, B has a circumferential socket, the size of which corresponds to half the thickness of the connector. Preferably, corner hollow brick B has a notch on the lateral surface. Preferably, hollow brick A and corner hollow brick B have each an additional reinforcing bar inside. Preferably, the socket is filled with sealing foam before assembly.

In effect of the invention it is possible to build structures using natural materials such as OSB boards, planks, beams, etc. with appropriately selected mounting dimensions so that only wood screws and a screwdriver could be used. Transport and unloading do not require heavy equipment, it is not troublesome because the size and weight of the elements is relatively small, compared to traditional materials. The process of construction does not require professional skills; the work comes down to arranging the timber hollow bricks like Lego blocks. It eliminates the cost of professional assistance. Moreover, dismantling a structure built using this technology is simple, and the recovered material can be re-used in full. The entire construction process is free of dust, noise, and similar kind of inconvenience. Taking into account the low transport costs, no cost of professional assistance and the minimal use of equipment, the entire cost of the finished building is very competitive in relation to the costs incurred in running a building site in a traditional way.

BRIEF DESCRIPTION OF THE SEVERAL VIEWS OF THE DRAWINGS

The subject of the invention in the embodiments is presented in the drawing.

DETAILED DESCRIPTION OF THE INVENTION

Figure 1:
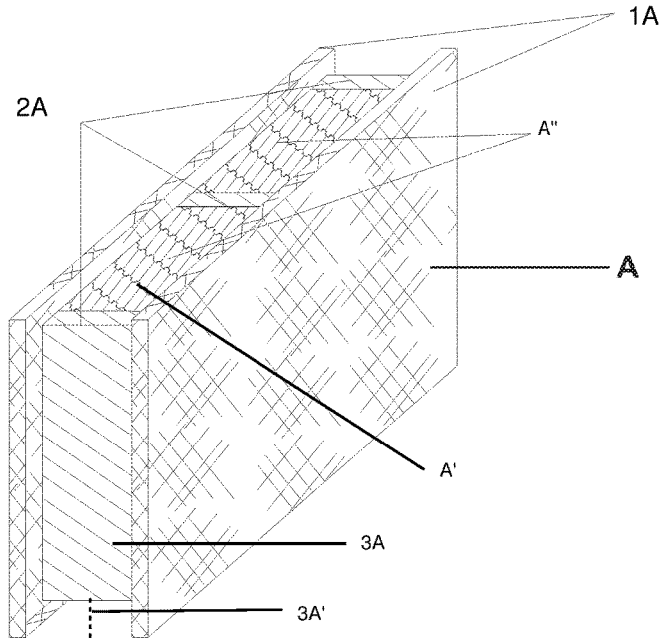
FIG. 1 shows a timber hollow brick A in the perspective view.
Figure 2:
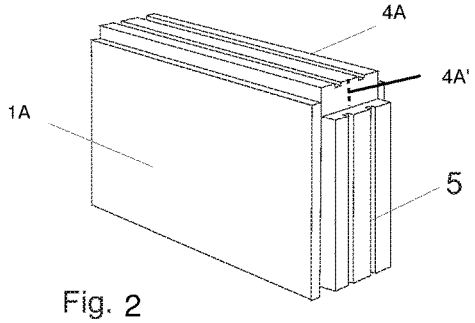
FIG. 2 shows a timber hollow brick A reinforced with a bar in the perspective view.
Figure 5:
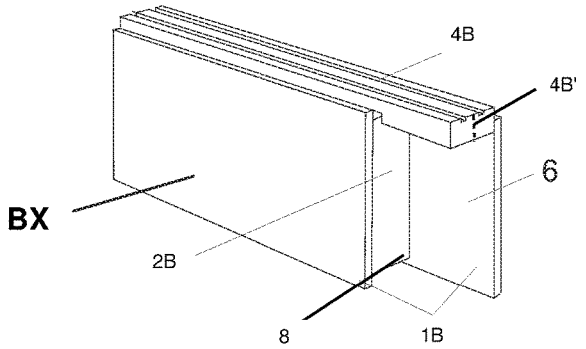
FIG. 5 shows a corner timber hollow brick BX in the perspective view.
Figure 3:
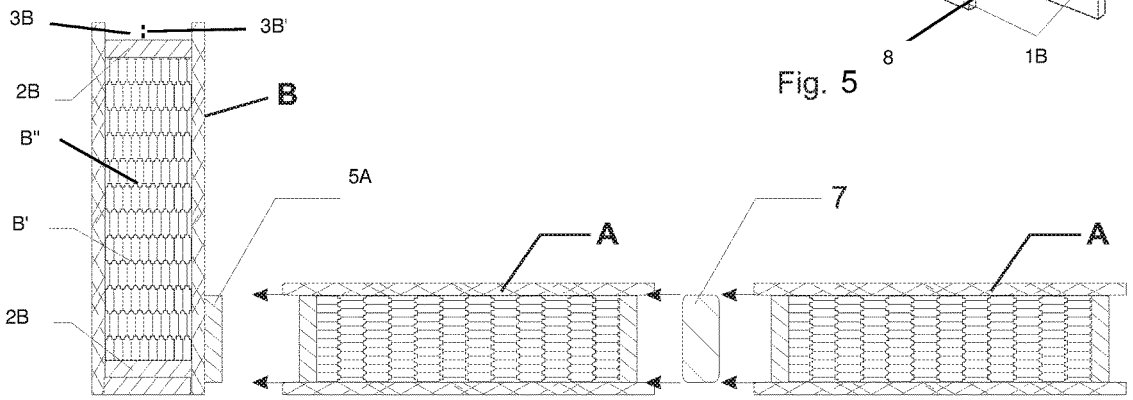
FIG. 3 shows a modular set of timber hollow bricks (A, B) in an end elevation view.
Figure 4:
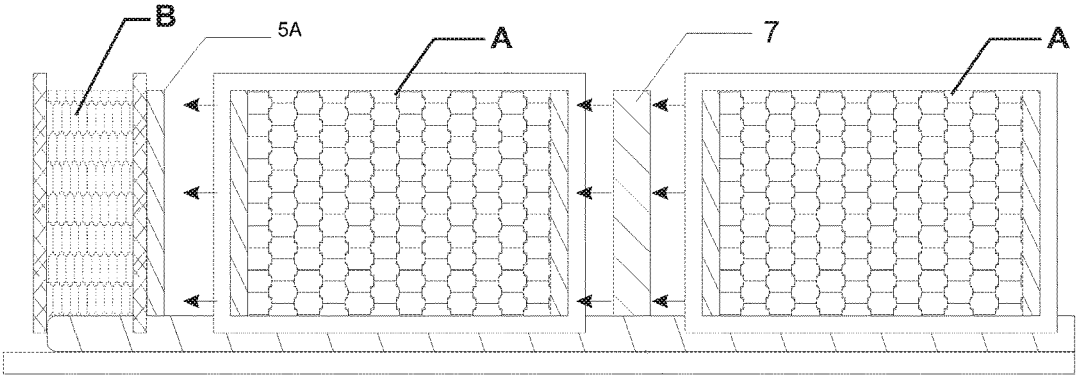
FIG. 4 shows a modular set of timber hollow brick (A, B) in the front elevation view.

The modular set consists of first timber hollow bricks A and second timber hollow bricks B, BX, as a corner timber hollow brick. The hollow bricks are made of boards 1 connected with crossbars 2A, 2B. In FIGS. 1-4, a first hollow brick A has two first boards 1A and a plurality of first crossbars 2A between the two first boards. In FIGS. 3-5, a second hollow brick (B in FIGS. 3-4, BX in FIG. 5) has two second boards 1B and a plurality of second crossbars 2B between the two second boards. Longer hollow bricks are additionally reinforced with a crossbar (not shown). The two first boards and the plurality of first crossbars form a first peripheral slot 3A having a first slot depth 3A' and first volume A' filled with a first insulation material A" in FIG. 1. The two second boards and the plurality of second crossbars form a second peripheral slot 3B having a second slot depth 3B' and second volume B' filled with a second insulation material B" in FIG. 4. The interior of the hollow bricks can be filled with Styrofoam insulating material as the first insulation material A" and the second insulation material B". The modular set of hollow bricks of FIGS. 3-4 has the first peripheral slot 3A of the first hollow brick A for fastening the vertical connectors 5A on the second hollow brick B. The set of the first hollow brick A and the second hollow brick BX of FIGS. 2 and 5 have the first peripheral slot 3A of the first hollow brick A for fastening the vertical connector 5 to the side surface connector 6 of the second hollow brick BX. In FIG. 2, there is a first horizontal connector 4A within a top of the first peripheral slot 3A and having a first horizontal connector thickness 4A'. Also, in FIG. 2 and FIG. 4, there is a vertical connector 5, 5A to be fitted within a side of the respective second hollow brick B or first peripheral slot 3A of the first hollow brick A, according to respective embodiments of the second hollow brick B, BX. In FIG. 5, there is a second horizontal connector 4B within a top of the second peripheral slot 3B and having a second horizontal connector thickness 4B'. Vertical connectors 5, 5A, first horizontal connector 4A, and second horizontal connector 4B are fastened with wall screws (not shown). Additionally, slot 3A of a first hollow brick can be filled with sealing foam 7, as shown in FIG. 3 and FIG. 4, before fitting. The corner hollow brick BX has a notch 8 in FIG. 5. The embodiment of the second hollow brick BX of FIG. 5 is further comprised of side surface connector 6 extending from one of the two second boards so as to form a corner hollow brick BX with a notch 8. The vertical connector engages the notch so as to connect the first hollow brick and the second hollow brick. The present invention is not limited to the embodiments described and illustrated here, but may be freely modified within the scope of the appended claims.

I claim:

1. A modular set for thermal insulation, the set comprising:

a first hollow brick having two first boards and a plurality of first crossbars between the two first boards, wherein the two first boards and the plurality of first crossbars form a first peripheral slot having a first slot depth and first volume filled with a first insulation material;

a second hollow brick having two second boards and a plurality of second crossbars between the two second boards, wherein the two second boards and the plurality of second crossbars form a second peripheral slot having a second slot depth and second volume filled with a second insulation material;

a first horizontal connector within a top of the first peripheral slot and having a first horizontal connector thickness; and a vertical connector within a side of the first peripheral slot; and a second horizontal connector within a top of the second peripheral slot and having a second horizontal connector thickness, wherein the second hollow brick is further comprised of a side surface connector extending from one of the two second boards so as to form a corner hollow brick with a notch, and wherein the vertical connector engages the notch so as to connect the first hollow brick and the second hollow brick.

2. The set, according to claim 1, wherein the first horizontal connector thickness is twice the first slot depth, and wherein the second horizontal connector thickness is twice the second slot depth.

3. The set, according to claim 1, wherein the first insulation material is comprised of sealing foam, and wherein the second insulation material is comprised of the sealing foam.

* * * * *